US012018906B2

(12) United States Patent
Jarvis

(10) Patent No.: US 12,018,906 B2
(45) Date of Patent: Jun. 25, 2024

(54) FIREARM SUPPRESSION SYSTEM

(71) Applicant: Jarvis Arms LLC, Rexburg, ID (US)

(72) Inventor: Lonnie Jarvis, Rexburg, ID (US)

( * ) Notice: Subject to any disclaimer, the term of this patent is extended or adjusted under 35 U.S.C. 154(b) by 0 days.

(21) Appl. No.: 18/382,845

(22) Filed: Oct. 23, 2023

(65) Prior Publication Data

US 2024/0142189 A1 May 2, 2024

Related U.S. Application Data

(60) Provisional application No. 63/419,776, filed on Oct. 27, 2022.

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 181/223; 89/14.4
See application file for complete search history.

(56) References Cited

U.S. PATENT DOCUMENTS

| | | | | |
|---|---|---|---|---|
| 6,425,310 | B1 * | 7/2002 | Champion | F41A 21/30 89/14.3 |
| 9,347,727 | B1 * | 5/2016 | Cler | F41A 21/30 |
| 9,739,560 | B1 * | 8/2017 | Salvador | F41A 21/34 |
| 10,605,558 | B1 * | 3/2020 | Marfione | F41A 21/30 |
| 11,333,458 | B1 * | 5/2022 | Hunt | F41A 21/30 |
| 11,761,725 | B1 * | 9/2023 | Sanders | F41A 21/325 89/14.3 |
| 11,774,205 | B1 * | 10/2023 | Kunsky | F41A 21/30 89/14.4 |
| 2015/0285575 | A1 * | 10/2015 | Sclafani | F41A 21/30 29/402.08 |
| 2020/0025494 | A1 | 1/2020 | Parker | |
| 2021/0041200 | A1 * | 2/2021 | Kras | F41A 21/30 |

* cited by examiner

*Primary Examiner* — Forrest M Phillips

(57) ABSTRACT

A firearm suppression system includes a housing, a muzzle adapter, an end cap, and a core. The housing includes a first aperture at a first end and a second aperture at a second end. An inner compartment may be interposed between the first aperture and the second aperture. The inner compartment may be configured to receive the core. The muzzle adapter may be threadably coupled near the first end of the housing, and the end cap may be threadably coupled to the second end of the housing. The core may be removably attachable to the housing and positioned within the inner compartment of the housing. Between an outer surface of the core and the inner surface of the housing may be a channel that equalizes pressure. The outer surface of the core may comprise a plurality of apertures that lead to baffles.

17 Claims, 17 Drawing Sheets

FIREARM SUPPRESSION SYSTEM

CROSS-REFERENCE TO RELATED APPLICATIONS

This application claims the benefit of U.S. Provisional Application Ser. No. 63/419,776, filed on Oct. 27, 2022, which is incorporated herein by reference.

TECHNICAL FIELD

The present disclosure relates to firearm suppressors. More particularly, the present disclosure relates to a firearm suppression system that reduces sound, recoil, and back gassing.

BACKGROUND

Firearms have been used for many years and have been a crucial part of many societies. Throughout the centuries firearms have changed in many ways. In particular, firearms have changed in shape, in functionality, and in components used. A relatively new component in the firearm industry is a suppressor. The suppressor made its appearance in the early 1900s. Suppressors were created to reduce muzzle flash and noise. Now they have become an important part of the firearm industry. Typically, suppressors are either monocore or baffle stack and function by utilizing a series of partitions, where expanding gases are trapped and remain until slowed and cooled before exiting the suppressor. Suppressors are often made from metal alloys, such as aluminum and stainless steel.

While suppressors on the market seek to reduce muzzle flash, noise and back gassing and increase accuracy, many fall short due to their configurations. In particular, some baffle stack suppressors may have baffles that don't work properly or as intended. Others may only reduce flash, noise, or back gassing but not all three. For example, while some suppressors found on the market may reduce noise, they may fall short in reducing muzzle flash, back gassing and/or recoil.

Accordingly, there is a need for a suppression system that reduces flash, noise, recoil, and back gassing while increasing accuracy. The present invention seeks to solve these and other problems.

SUMMARY OF EXAMPLE EMBODIMENTS

In one embodiment, a firearm suppression system comprises a housing including a first end and a second end, a muzzle adapter, an end cap, and a core. The housing may be cylindrical-shaped. The housing may be manufactured from titanium. To manufacture the housing, the housing may be printed via a three-dimensional printer. The housing includes an inner surface and an outer surface. The housing includes a first aperture at a first end and a second aperture at a second end. An inner compartment may be interposed between the first aperture and the second aperture. The inner compartment may be configured to receive the core. The muzzle adapter may be coupled proximate the first end of the housing, and the second end of the housing may receive the end cap which is removably attachable. The muzzle adapter and end cap may include threaded fasteners so as to be threadably coupleable to the core and housing, respectively.

The end cap may be threadably coupled to the second end of the housing. Other fastening mechanisms may be envisioned. The end cap may comprise a plurality of vent apertures that allow gas from the fired cartridge to escape the firearm suppression system. The end cap may also comprise a projectile/bullet aperture where the bullet fired from a cartridge may leave the firearm and system.

The core may be removably attachable to the housing and positioned within the inner compartment of the housing. The core may be threadably coupled to the housing via the threaded fastener at the first end of the housing. Further, the core may be substantially cylindrical-shaped so as to fit within the housing. Between an outer surface of the core and the inner surface of the housing, may be a channel that equalizes pressure. The outer surface of the core may comprise a plurality of hexagonal apertures that lead to baffles that angle towards the projectile passage. The baffles may be positioned along the length of the core.

In one embodiment, a firearm suppression system comprises a housing including a first end and a second end, an end cap, and a core. The housing may comprise an inner surface and an outer surface. The housing includes a first aperture at the first end and a second aperture at the second end. An inner compartment may be interposed between the first aperture and the second aperture. The inner compartment may be configured to receive the core. The end cap may comprise a plurality of vent apertures that allow gas from the fired cartridge to escape the firearm suppression system. The end cap may also comprise a projectile/bullet aperture where the bullet fired from a cartridge may leave the gun and system. The core may be removably attachable to the housing and positioned within the inner compartment of the housing. The core may comprise a first channel and a second channel both of which wrap around an outer surface of the core and assist in removing gas from the system. The core may be printed via a three-dimensional printer. The core may comprise a plurality of core apertures that allow gas passing from the projectile and operating system to pass to the channels. The core may include an inner surface that comprises baffles that function in tandem with the plurality of core apertures.

In one embodiment, a firearm suppression system comprises a housing including a first end and a second end, a rear cap, and a core. The housing includes a first aperture at the first end and a second aperture at the second end. An inner compartment may be interposed between the first aperture and the second aperture. The inner compartment may be configured to receive the core. The rear cap may be configured to secure the core in the housing. The core may be removably attachable to the housing and positioned within the inner compartment of the housing. The core may comprise a protrusion that lines up with and fits into a notch in the second end of the housing, thereby providing a secure fit between the core and the housing. The core may comprise a plurality of core apertures that allow gas passing from the projectile and operating system to pass via the system. The core may include an inner surface that comprises baffles that function with the plurality of core apertures.

In one embodiment, a firearm suppression system comprises a housing, a core, an end cap, and a disc. The disc (e.g., shutter) may be placed proximate the end cap. The disc may comprise a plurality of fingers pointing inward towards a second projectile aperture and the core when assembled.

In one embodiment, an end cap system may comprise an end cap that may be used with any of the other firearm suppression systems described herein. The end cap may comprise a projectile aperture, where the projectile may exit the suppression system. The end cap may comprise a pressure channel that receives pressure from the exiting projectile. The pressure channel, running parallel to the projectile aperture, may lead to an end cap closure channel, being perpendicular thereto. The end cap closure channel may lead to the projectile aperture and narrow proximate the projectile aperture, thereby creating a projectile ledge. The end cap closure channel may receive a closure member that is positioned therein. Further, a key comprising a shaft and a head may be placed in the end cap closure channel. The shaft may protrude into the projectile aperture to reduce gas flow exiting the system.

In one embodiment, a firearm suppression system comprises a housing and a core. The core may be removably attachable to the housing and positioned within the housing. An outer surface of the core may comprise a plurality of core apertures. The core may include an inner surface that comprises baffles that interact with the plurality of core apertures. These baffles may be extruded inward at various prescribed angles. Passing through one or more of the baffles may be one or more tubes. The one or more tubes may take pressure from the fired projectile from the high-pressure regions of the suppression system and direct that pressure to a low-pressure region in the opposite direction. This interruption slows the gases from exiting the firearm suppression system resulting in reduced sound.

In one embodiment, a firearm suppression system may include a first member coupleable to a muzzle brake. The muzzle brake may include a first portion and a second portion. The first portion may have a barrel with a plurality of vent apertures. The barrel may have a projectile passage. The second portion may comprise a first adapter that interacts with the first member and a barrel of a firearm. The muzzle brake may be manufactured by a three-dimensional printing process.

DETAILED DESCRIPTION OF EXAMPLE EMBODIMENTS

Figure 1:
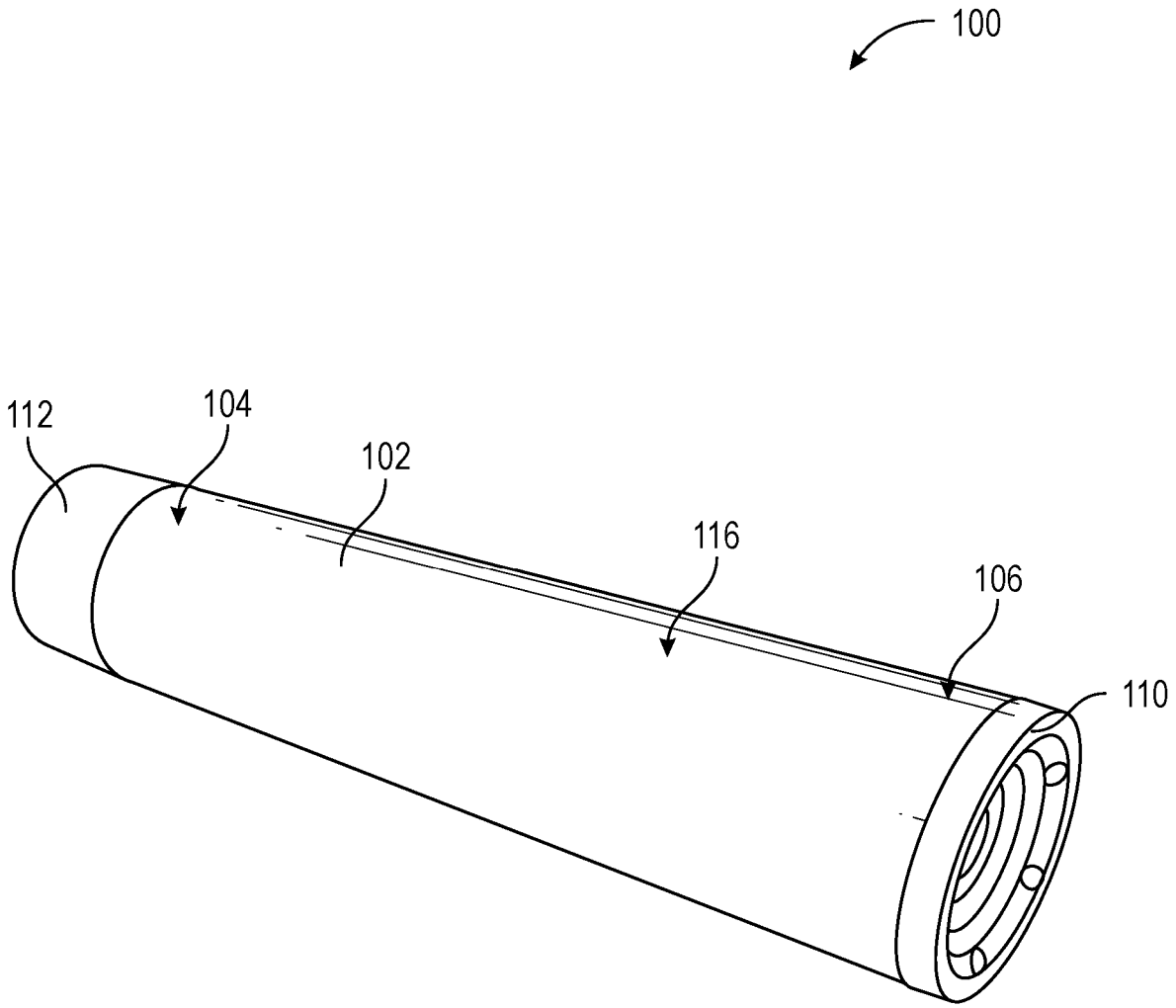
FIG. 1 illustrates a side perspective view of a firearm suppression system.

While embodiments of the present disclosure may be subject to various modifications and alternative forms, specific embodiments have been shown by way of example in the drawings and will be described in detail herein. However, the present disclosure is not intended to be limited to the particular features, forms, components, etc. disclosed. Rather, the present disclosure will cover all modifications, equivalents, and alternatives falling within the scope of the present disclosure.

Reference to the invention, the present disclosure, or the like are not intended to restrict or limit the invention, the present disclosure, or the like to exact features or steps of any one or more of the exemplary embodiments disclosed herein. References to "one embodiment," "an embodiment," "alternate embodiments," "some embodiments," and the like, may indicate that the embodiment(s) so described may include a particular feature, structure, or characteristic, but not every embodiment necessarily includes the particular feature, structure, or characteristic.

Any arrangements herein are meant to be illustrative and do not limit the invention's scope. Although specific terms are employed herein, they are used in a generic and descriptive sense only and not for purposes of limitation. Unless otherwise defined herein, such terms are intended to be given their ordinary meaning not inconsistent with that applicable in the relevant industry and without restriction to any specific embodiment hereinafter described.

It will be understood that the steps of any such processes or methods are not limited to being carried out in any particular sequence, arrangement, or with any particular graphics or interface. In fact, the steps of the disclosed processes or methods generally may be carried out in various, different sequences and arrangements while still being in the scope of the present invention. Certain terms are used herein, such as "comprising" and "including," and similar terms are meant to be "open" and not "closed" terms. These terms should be understood as, for example, "including, but not limited to."

As previously described, there is a need for a suppression system that reduces flash, noise, and back gassing while increasing accuracy. The present invention seeks to solve these and other problems.

The firearm suppression system described herein is configured to optimize the relationships between sound, recoil, and back gassing. It will be understood that various embodiments of the firearm suppression system may optimize one relationship over another. For example, in one embodiment, the firearm suppression system may seek to prevent back gassing. The firearm system may comprise a housing, a core, and an end cap. The core may be a three-dimensional printed mono-core. The core may include hexagonal-shaped apertures (e.g., honey comb shaped) that connect to and function with baffles. The core may be positioned in the housing. In some embodiments, the core and housing may be printed or manufactured as a single unit. It will be understood that due to the configuration of the core and housing, the firearm suppression system essentially eliminates back gassing. Further, the back gassing is diminished by pressure equalizing technology (PET). PET is the process in which high-pressure gases entering into the core and housing immediately fills the entire volume of the housing. By filling the entire area of the housing, the pressure from the gas operated gun is lowered and equalized.

Because of the unique configuration of the housing and the core, the firearm suppression system can manage gas flows and baffle angles in order to statistically balance sound, recoil, and back gassing to optimize performance. Other suppressors on the market have struggled to reduce sound and back gassing in a suppressor due to the inverse relationship between the two. It will be appreciated that some embodiments of the firearm suppression system are statistically balanced so as to reduce or eliminate the effects of back gassing into the user's face when operating a gas operated firearm, such as an automatic rifle, while also making it hearing safe. Because these are inverse relationships others in the past have not been able to design a product that can accomplish both items—reducing noise and back gassing.

As shown in FIGS. 1-6, in one embodiment, a firearm suppression system 100 comprises a housing 102 including a first end 104 and a second end 106, a muzzle adapter 108, an end cap 110, and a core 112. The housing 102 may be cylindrical-shaped. In some embodiments, the housing 102 may be rectangular-shaped or any other shape may be envisioned. In some embodiments, an inner surface 114 of the housing 102 may be substantially circular in shape while an outer surface 116 of the housing 102 is, for example, rectangular shaped. It could be envisioned that the housing 102 may vary in circumference and in length. That is, different calibers, from .17 caliber to .30 caliber, may use different sizes of housings, or the same size of housing. For example, a first size of housing 102 may be used for a .22 caliber firearm while a second size of housing may be used for a .30 caliber. The housing 102 and the core 112 may be custom made, in some embodiments, for a specific caliber. It will be appreciated that there may be any number of housing sizes. The housing 102 may be manufactured from titanium. Other housing materials may include, but are not limited to, aluminum, steel, or carbon fiber. To manufacture the housing 102, the housing 102 may be printed via a three-dimensional printer, milled, or manufactured by any other means known in the art. In some embodiments, the core and housing may be printed or manufactured as a single unit without multiple removable components.

Furthermore, the housing 102 includes the inner surface 114 and the outer surface 116, both of which may create a cylindrically-shaped housing. The housing 102 includes a first aperture 118 at the first end 104 and a second aperture 120 at the second end 106. An inner compartment 122 may be interposed between the first aperture 118 and the second aperture 120. The inner compartment 122 may be substantially the same circumference from the first end 104 to the second end 106. As shown, the inner compartment 122 may be configured to receive the core 112.

Proximate the first end 104 of the housing 102 may be the muzzle adapter 108 that is removably attachable to the core and/or housing, and the second end 106 of the housing 102 may comprise the end cap 110 that is removably attachable thereto. In some embodiments, the muzzle adapter 108 may be present in the core 112 and/or housing 102 so as to be directly threaded onto a firearm. The muzzle adapter 108 and end cap 110 may include threaded fasteners 124 so as to be threadably coupleable to housing 102 and/or the core 112. In some embodiments, the muzzle adapter 108 may be 1⅜"×24 Threads Per Inch, which is a universal attachment for many firearms. Accordingly, the firearm suppression system 100 may be coupled to numerous different types of firearms.

Figure 2:
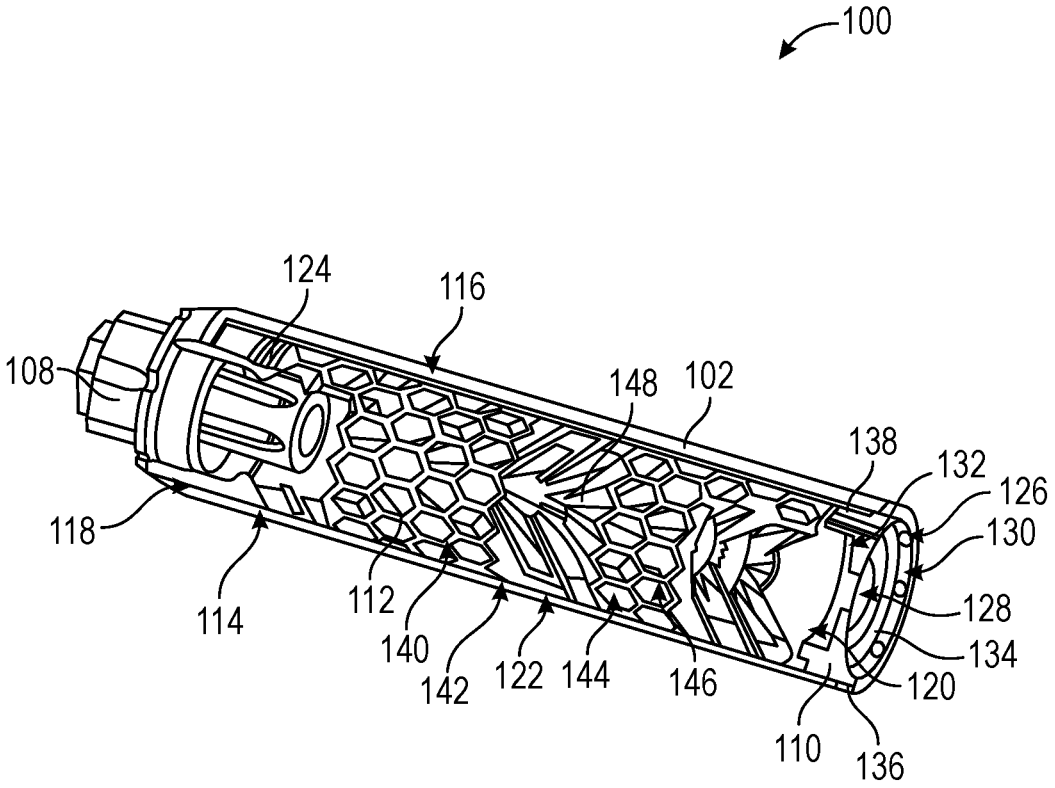
FIG. 2 illustrates a partial cutaway view of a firearm suppression system.
Figure 3:
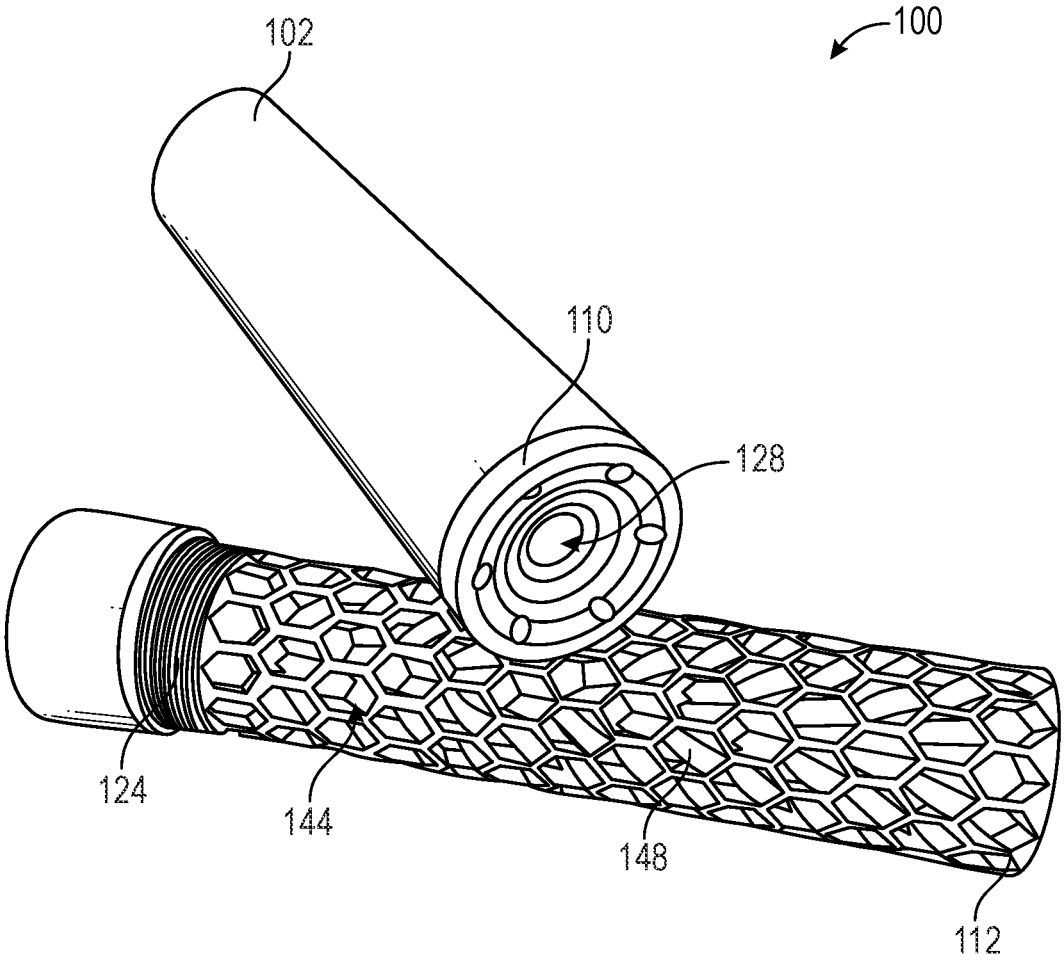
FIG. 3 illustrates a side perspective view of a housing and a core of a firearm suppression system.

The end cap 110 may be threadably coupled to the second end 106 of the housing 102. Other fastening mechanisms may be envisioned. The end cap 110 may rest against the second end 106 of the housing 102. Further, the end cap 110 may have a circumference that matches the circumference of the housing 102, thereby making the end cap 110 flush with the housing 102. However, it will be understood that the end cap 110 may be numerous circumferences. As illustrated in FIG. 2, the end cap 110 may comprise a plurality of vent apertures 126 that allow gas from the fired cartridge to escape the firearm suppression system 100 and, more particularly, the inner compartment 122. The plurality of vent apertures 126 may be spaced apart and positioned in an annular formation on the end cap 110, or may be in any other formation. The end cap 110 may also comprise a projectile/bullet aperture 128 where the bullet fired from a cartridge may leave the gun and system 100. The end cap 110 may be machined from a solid piece of material, such as aluminum, steel, or titanium. In some embodiments, the end cap 110 may be printed via a three-dimensional printer out of titanium, plastics, or any other material. The end cap 110 includes a first side 130 facing outward away from the housing 102 and a second side 132 facing inward towards the inner compartment 122 and firearm's muzzle. The first side 130 of the end cap 110 may be concave. With the first side 130 being concave, less material is needed, which reduces the weight of the end cap 110 and the firearm suppression system 100 overall. The end cap 110 may have annular ridges 134 increasing in diameter as they move from the projectile aperture 128 outward. In some embodiments, the first side 130 may be convex. While in other embodiments, the first side 130 may be flat. The second side 132 of the end cap 110 includes a ledge 136 that rests on and is flush with the second end 106 of the housing 102. A sidewall 138 that couples to the ledge 136 may be an annular protrusion that contacts the inner surface 114 of the housing 102. The sidewall 138 may be threaded. To insert the end cap 110 into the housing 102, a user may use a tool or their fingers to engage the end cap 110 with the threaded fastener 124 until the end cap 110 is tightly secured. At times, the firearm suppression system 100 may operate without an end cap 110, thereby allowing the gasses to exit the inner compartment 122. In some embodiments, a disc may be interposed between the end cap 110 and the core 112. With the disc positioned thereinbetween, additional noise reduction may be experienced. The disc may be a circumference that reflects the circumference of the inner compartment 122.

The core 112 may be removably attachable to the housing 102 and positioned within the inner compartment 122 of the housing 102. It will be appreciated that the core 112 may easily be removed from the housing 102 and cleaned, thereby making maintenance of the firearm suppression system 100 simple. The core 112 may be threadably coupled to the housing 102 via the threaded fastener 124 at the first end 104 of the housing 102. Further, the core 112 may be substantially cylindrical-shaped so as to fit within the housing 102. Between an outer surface 140 of the core 112 and the inner surface 114 of the housing 102, there may be a channel 142 that equalizes pressure. The channel 142 may surround the core 360 degrees starting at the first end 104 of the housing 102 and ending at the second end 106 of the housing 102. The channel 142 allows the incoming high pressure to enter into the core 112, immediately flow to the outside of the core between the housing 102 and the core 112 and proceed down the entire length of the firearm suppression system 100. This equalizes the high pressures gas through the entire system 100 rapidly so that high pressure is converted to low pressure, which means that the operating system of the firearm is not affected as it typically would be with high pressure. Due to this, there is a reduction or elimination of additional gases that travel back through the gun's operating system and into the user's face. As such, the pressure channel 142 equalizes pressure and moves the pressure towards and out of the vent apertures 126. In some embodiments, the firearm suppression system 100 may lack vent apertures 126 which may, for example, achieve greater sound reduction. The core 112 may be printed via a three-dimensional printer, or manufactured by other means known in the art. The core 112 may be titanium, aluminum, ceramic, or other materials known in the art. It will be appreciated that numerous cores may be used with a single housing 102 so as to allow a user to switch cores to address a particular caliber.

Figure 4:
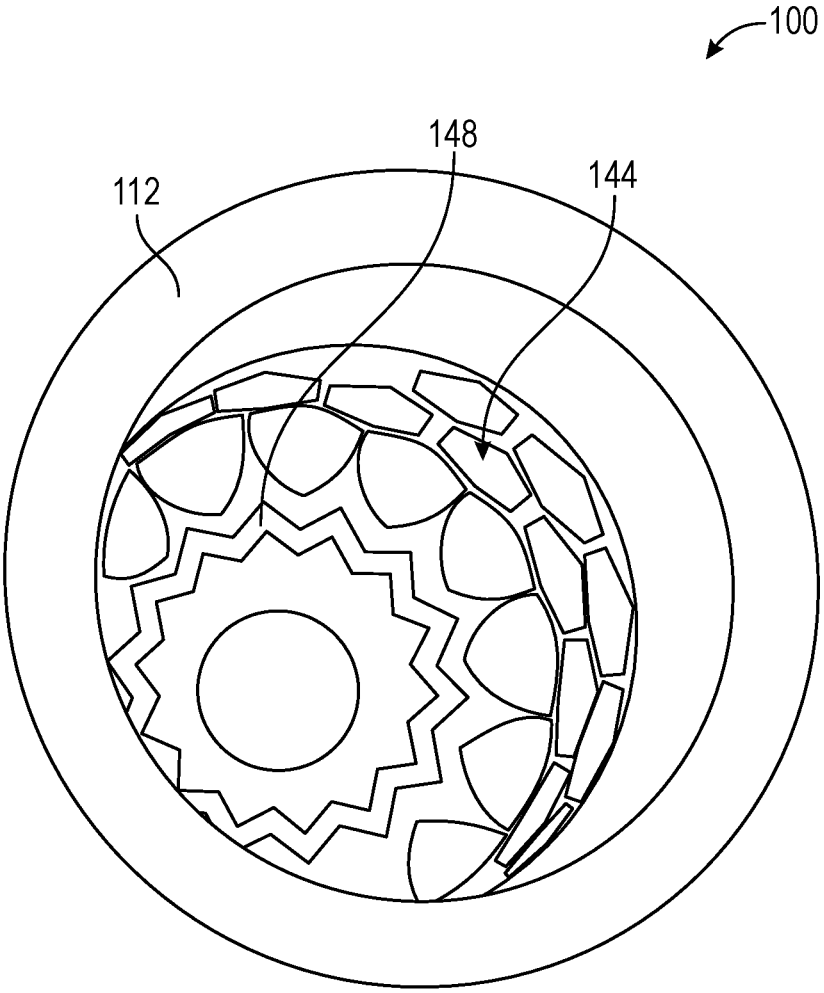
FIG. 4 illustrates a rear perspective view of a core of a firearm suppression system.
Figure 5:
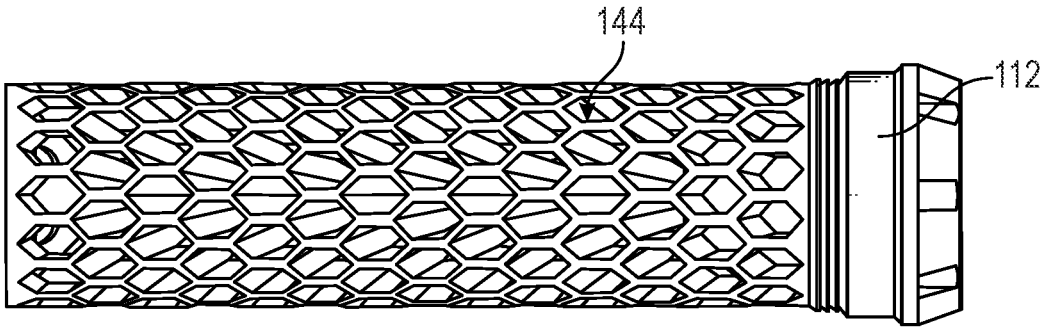
FIG. 5 illustrates a side elevation view of a core of a firearm suppression system.
Figure 6:
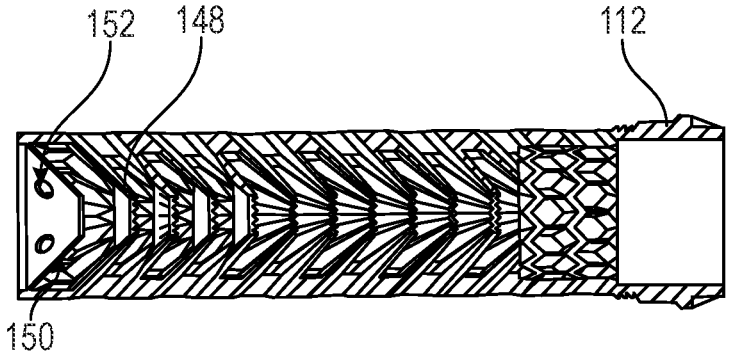
FIG. 6 illustrates a cutaway view of a core of a firearm suppression system.

The outer surface 140 of the core 112 may comprise a plurality of core apertures 144 that allow gas passing from the projectile and operating system to pass to the channel 142. The plurality of core apertures 144 may be substantially hexagonal shaped and have the appearance of a honeycomb. However, in other embodiments, the plurality of core apertures 144 may be circular, square shape, or any other shape. As shown in FIGS. 4 and 6, the core 112 may include an inner surface 146 that comprises baffles 148 that interact with the plurality of core apertures 144 (FIG. 5). These baffles 148 may be extruded inward at various prescribed angles (FIG. 6). The baffles 148 may be angled between 30 degrees to 70 degrees, but more preferably between 40 degrees to 60 degrees. With baffles 148 being set between the aforementioned ranges, the baffles 148 have additional surface area for heat transfer, thereby reducing the effects of the gasses from the fired projectile. A front end 150 of the core 112, positioned near the end cap 110, may include a baffle (e.g., end cap baffle) with baffle apertures 152 to allow additional gas to escape the core 112 and the firearm suppression system 100. In some embodiments, gases moving down the length of the housing 102 may contact the end cap 110 and re-enter the last baffle so as to exit the baffle apertures 152, which lead to the vent apertures 126. The baffles 148 may be positioned along the length of the core 112. The configuration of the baffles 148 may be generally conically shaped with a hexagonal-like border circumscribing the baffles 148. In some embodiments, the baffles may be corrugated, star shaped, diamond shaped, or any other shape to maximize surface area. It will be appreciated that the configuration of the baffles 148 increases and maximizes surface area for cooling hot gases from the exiting projectile quicker while passing through the system 100. The baffles 148 may angle downward until a projectile passage 154, which may be located at the center of the core and center of the baffles 148 that extends from one end to the other.

Because of the design of the core 112, the system 100 can be optimized to get the desired relationship between sound, recoil, and back gassing. In other suppressors found on the market, the gas enters at a high pressure and moves from baffle to baffle filling each area with gas. Then the gas moves to the next baffle to be filled. While the gasses are being slowed down as they move forward, until the gas fills the entire suppressor and the pressure is progressively decreased. Then high pressure is present during the operating system's cycle time. During this time, the high-pressure travels back through the gas tube and increases the gasses flowing to the operating system. This causes increased gasses in the user's face, increased bolt velocity, and increased sound to the user's ears. While this process is efficient in reducing sound on non-gas operated guns, it has a negative effect on back gassing with gas operated firearms. In another popular design, the suppressor uses "flow through technology," which does not use baffles to slow the gas but uses chambers that flow gases back and forth and out the end of the suppressor. This design is low pressure and is good for back gassing but not for sound reduction. Accordingly, the firearm suppression system 100 addresses both back-gassing and sound reduction to a hearing safe level on gas operated systems, like an AR, by statistically optimizing the relationship between them. The system 100 may also reduce first round pop based upon its configuration. It may also be appreciated that the system utilizes a monocore with baffles positioned therein to reduce sound, recoil, and back gassing.

Figure 7:
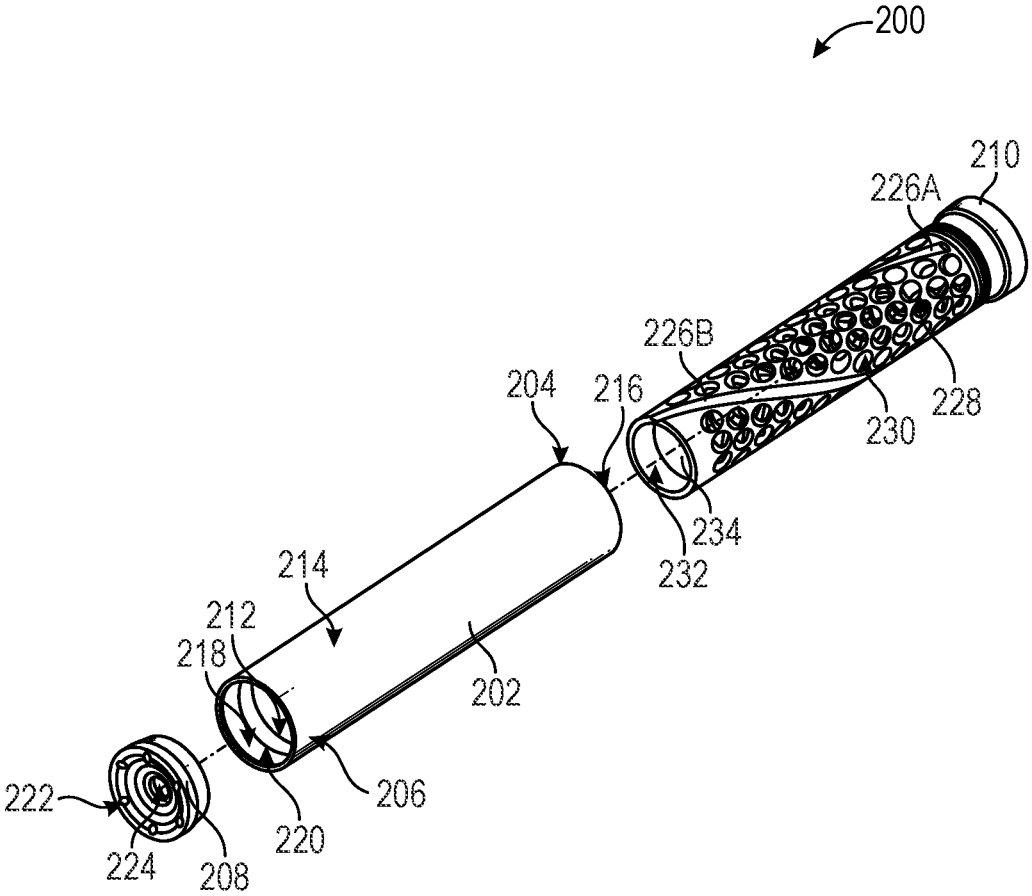
FIG. 7 illustrates an exploded view of a firearm suppression system.
Figure 8:
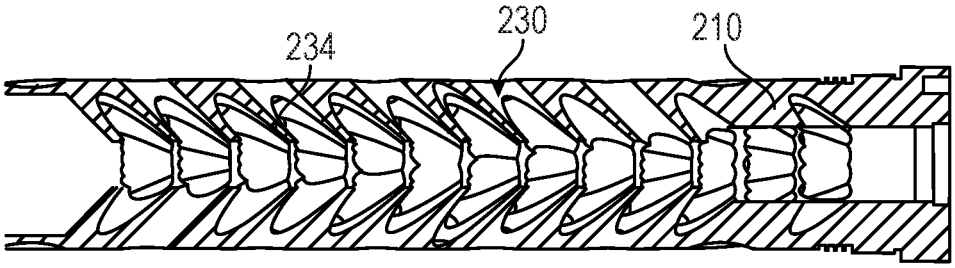
FIG. 8 illustrates a cutaway view of a core of a firearm suppression system.

As shown in FIGS. 7-8, in one embodiment, a firearm suppression system 200 comprises a housing 202 including a first end 204 and a second end 206, an end cap 208, and a core 210. The housing 202 may be cylindrical shaped. In some embodiments, the housing 202 may be rectangular shaped or any other shape may be envisioned. The housing 202 may comprise an inner surface 212 and an outer surface 214. It could be envisioned that the housing 202 may vary in circumference and in length. To manufacture the housing 202, the housing 202 may be printed via a three-dimensional printer, milled, or manufactured by any other means known in the art. The housing 202 includes a first aperture 216 at the first end 204 and a second aperture 218 at the second end 206. An inner compartment 220 may be interposed between the first aperture 216 and the second aperture 218. The inner compartment 220 may be configured to receive the core 210.

The end cap 208 may be threadably coupled to the second end 206 of the housing 202. Other fastening mechanisms may be envisioned. The end cap 208 may rest against the second end 206 of the housing 202. Further, the end cap 208 may have a circumference that matches the circumference of the housing 202, thereby making the end cap 208 flush with the housing 202. The end cap 208 may comprise a plurality of vent apertures 222 that allow gas from the fired cartridge to escape the firearm suppression system 200 and, more particularly, the inner compartment 220. The end cap 208 may also comprise a projectile/bullet aperture 224 where the bullet fired from a cartridge may leave the gun and system 200.

The core 210 may be removably attachable to the housing 202 and positioned within the inner compartment 220 of the housing 202. The core 210 may be threadably coupled to the housing 202 at the first end 204 of the housing 202. Further, the core 210 may be substantially cylindrical shaped so as to fit within the housing 202. The core 210 may comprise a first channel 226A and a second channel 226B both of which wrap around an outer surface 228 of the core 210 and assist in removing gas from the system 200. The core 210 may be printed via a three-dimensional printer, or manufactured by other means known in the art. The core 210 may be titanium, aluminum, ceramic, or other materials known in the art. The outer surface 228 of the core 210 may comprise a plurality of core apertures 230 that allow gas passing from the projectile and operating system to pass to the channels 226A, 226B. The plurality of core apertures 230 may be ovular shaped, or any other shape. The core 210 may include an inner surface 232 that comprises baffles 234 that couple to the plurality of core apertures 230. These baffles 234 may be extruded inward at a prescribed angle. The baffles 234 may be positioned along the length of the core 210. The configuration of the baffles 234 may be generally conically shaped. It will be appreciated that the configuration of the baffles 234 increase surface area for cooling hot gases from the exiting projectile quicker while passing through the system 200.

Figure 9:
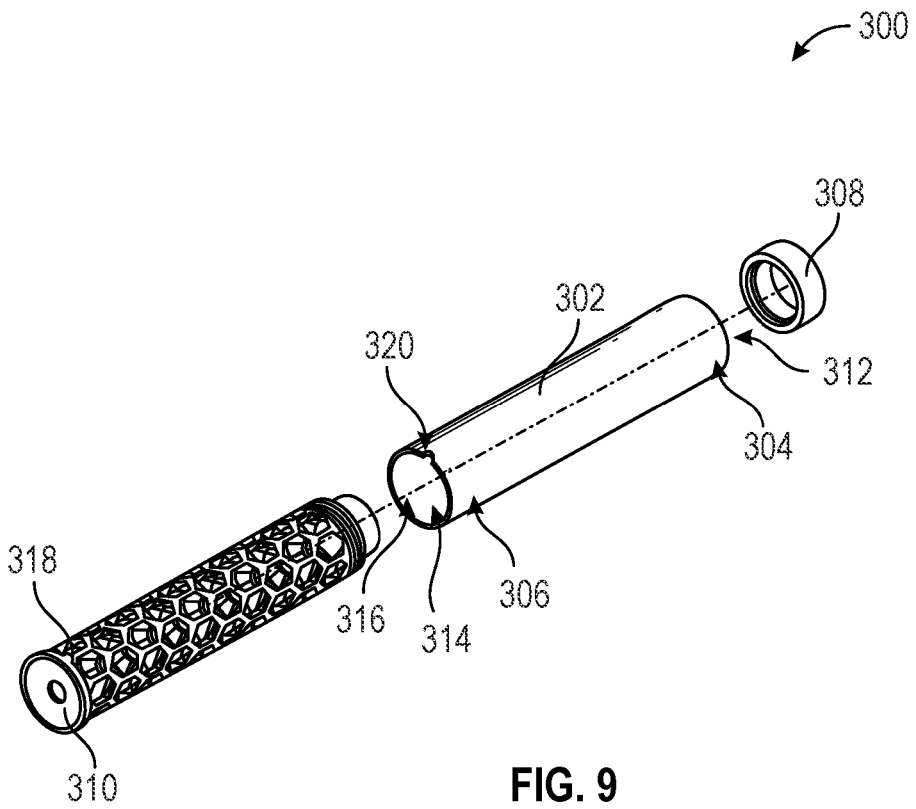
FIG. 9 illustrates an exploded view of a firearm suppression system.
Figure 10:
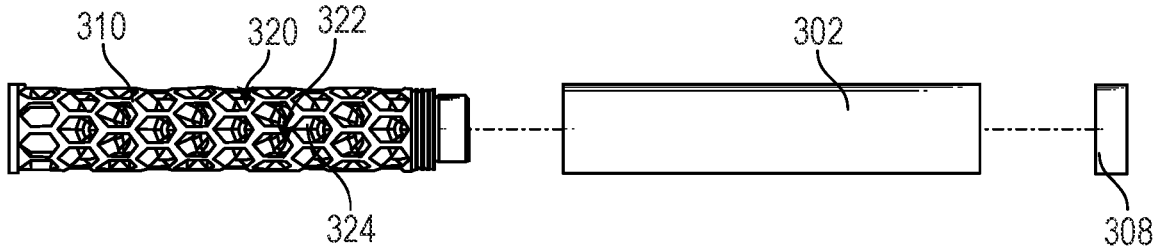
FIG. 10 illustrates an exploded view of a firearm suppression system.

As shown in FIGS. 9-10, in one embodiment, a firearm suppression system 300 comprises a housing 302 including a first end 304 and a second end 306, a rear cap 308, and a core 310. The housing 302 may be cylindrical shaped. The housing 302 may be printed via a three-dimensional printer, milled, or manufactured by any other means known in the art. The housing 302 includes a first aperture 312 at the first end 304 and a second aperture 314 at the second end 306. An inner compartment 316 may be interposed between the first aperture 312 and the second aperture 314. The inner compartment 316 may be configured to receive the core 310. The rear cap 308 may be threadably coupled to the first end 304 of the housing 302. The rear cap 308 may rest against the first end 304 of the housing 302. The rear cap 308 may be configured to secure the core 310 in the housing 302.

The core 310 may be removably attachable to the housing 302 and positioned within the inner compartment 316 of the housing 302. The core 310 may be threadably coupled to the housing 302 via the rear cap 308. Further, the core may comprise a protrusion 318 that lines up with and fits into a notch 320 in the second end 306 of the housing 302, thereby providing a secure fit between the core 310 and the housing 302. Further, the core 310 may be substantially cylindrical shaped so as to fit within the housing 302. The core 310 may be printed via a three-dimensional printer, or manufactured by other means known in the art. The core 310 may be titanium, aluminum, ceramic, or other materials known in the art. The core 310 may comprise a plurality of core apertures 320 that allow gas passing from the projectile and operating system to pass via the system 300. The plurality of core apertures 320 may be hexagonal shaped. The core 310 may include an inner surface 322 that comprises baffles 324 that couple to the plurality of core apertures 320. It will be appreciated that the configuration of the baffles 324 increase surface area for cooling hot gases from the exiting projectile quicker while passing through the system 300.

Figure 11:
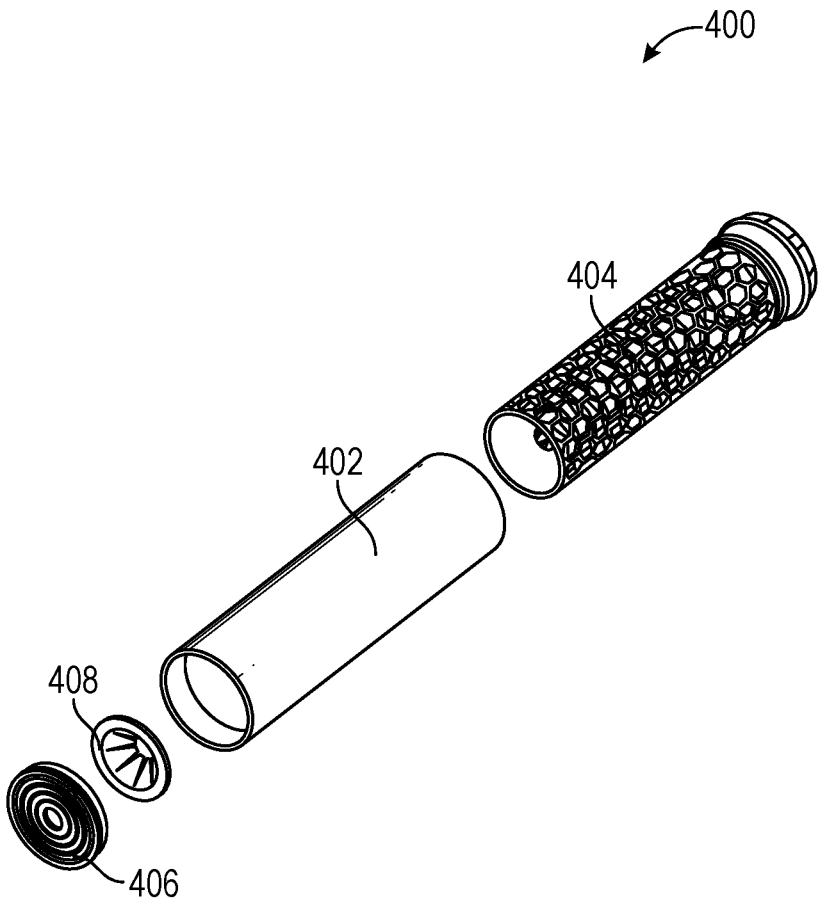
FIG. 11 illustrates an exploded view of a firearm suppression system.
Figure 12:
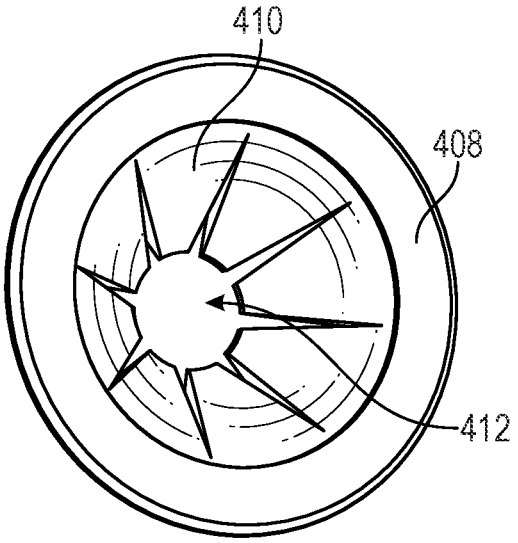
FIG. 12 illustrates a front perspective view of a disc of a firearm suppression system.
Figure 13:
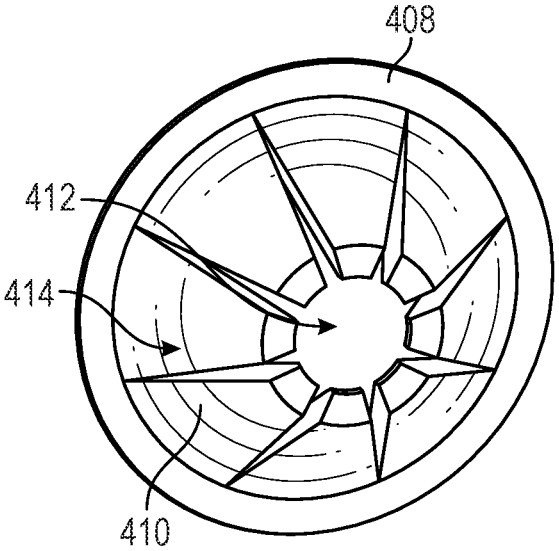
FIG. 13 illustrates a rear perspective view of a disc of a firearm suppression system.

As shown in FIGS. 11-13, in one embodiment, a firearm suppression system 400 comprises a housing 402, a core 404, an end cap 406, and a disc 408. The housing 402, the core, 404, and the end cap 406 may be similar to any of the previously discussed embodiments, such as embodiment 100. The disc 408 (e.g., shutter) may be placed proximate the end cap 406. In some embodiments, the disc 408 and its functions may be incorporated into the end cap 406, or in other words may be the end cap 406. In other embodiments, the disc/shutter 408 may be a single unit with the core and other limitations, being manufactured from a single piece of material. The disc 408 may comprise a plurality of fingers 410, generally triangular shaped, pointing inward towards a second projectile aperture 412 and the core 404 when assembled. As the pressure from a bullet contacts an inner face 414 of the disc 408 and temporarily restricts the diameter of the second projectile aperture 412 to a smaller diameter. After the pressure is lowered, the second projectile aperture 412 returns to its resting diameter. It will be appreciated that the disc 408 may be produced in numerous configurations, such as any apparatus that is triggered by pressure which restricts the gas flow from exiting the aperture or apertures of the system or directly integrated with an end cap.

Figure 14:
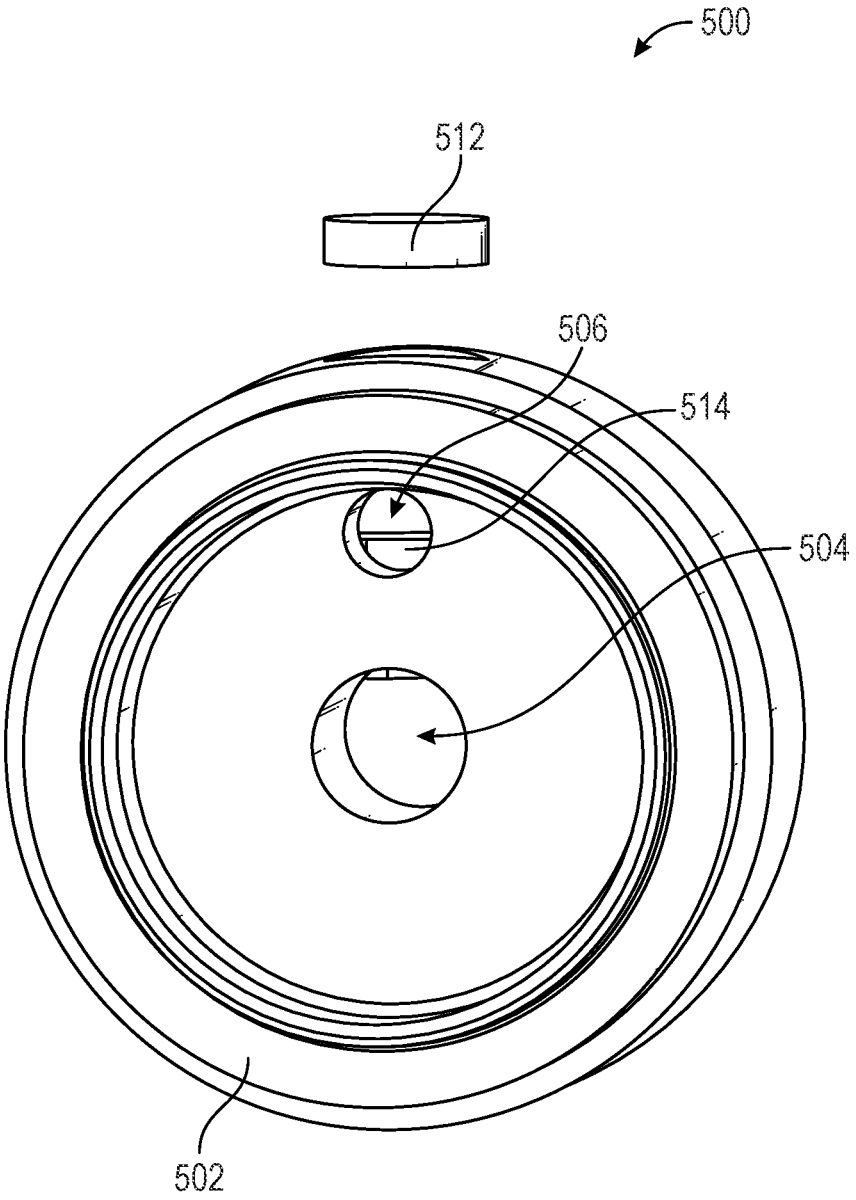
FIG. 14 illustrates a rear perspective view of an end cap of a firearm suppression system.
Figure 15:
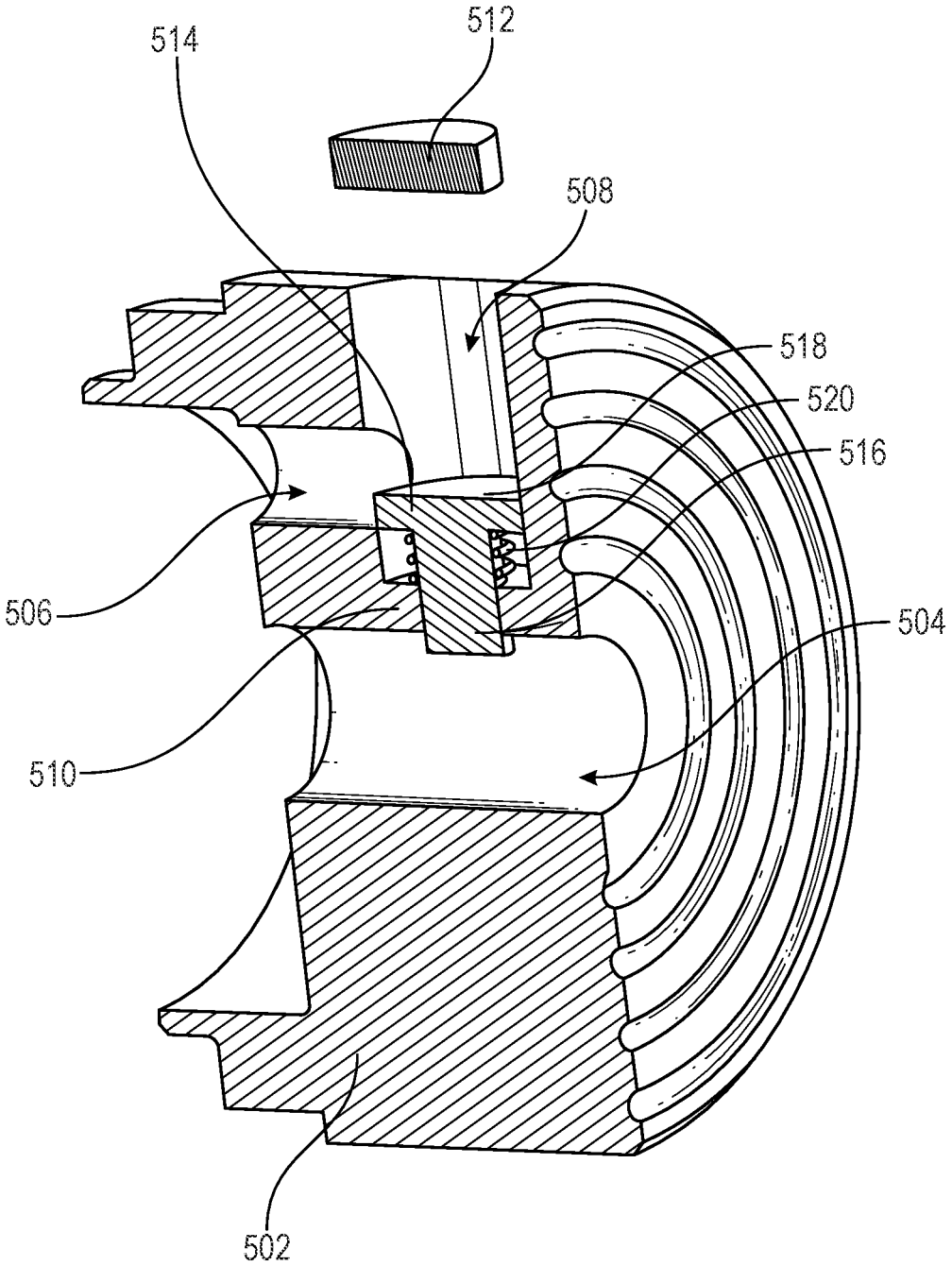
FIG. 15 illustrates a cutaway view of an end cap of a firearm suppression system.

As shown in FIGS. 14-15, in one embodiment, an end cap system 500 may comprise an end cap 502 that may be used with any of the other firearm suppression systems 100, 200, 300, 400. The end cap 502 may be actuated by pressure. That is, pressure from gasses after a bullet is fired may close a projectile aperture 504 a designated amount, similar to a shutter. This may happen as soon as the bullet/projectile exits the system 500, which produces a quieter system by slowing the release of gases outside of the fire suppression system. The end cap 502 may comprise the projectile aperture 504, where the projectile may exit the suppression system. The end cap 502 may comprise a pressure channel 506 that receives pressure from the exiting projectile. The pressure channel 506, running parallel to the projectile aperture 504, may lead to an end cap closure channel 508, being perpendicular thereto. The end cap closure channel 508 may lead to the projectile aperture 504 and narrow proximate the projectile aperture 504, thereby creating a projectile ledge 510. The end cap closure channel 508 may receive a closure member 512 that is positioned therein. Further, a key 514 may comprise a shaft 516 and a head 518 may be placed in the end cap closure channel 508. More particularly, the shaft 516 may comprise a spring 520 that is positioned under the head 518 and down the shaft 516, resting on the projectile ledge 510. The shaft 516 may protrude into the projectile aperture 504. The pressure enters into a pathway in the end cap 502, pushes down on the key 514, compresses the spring 520 and moves the shaft 516 into the projectile aperture 504 to restrict the flow of gases.

Figure 16:
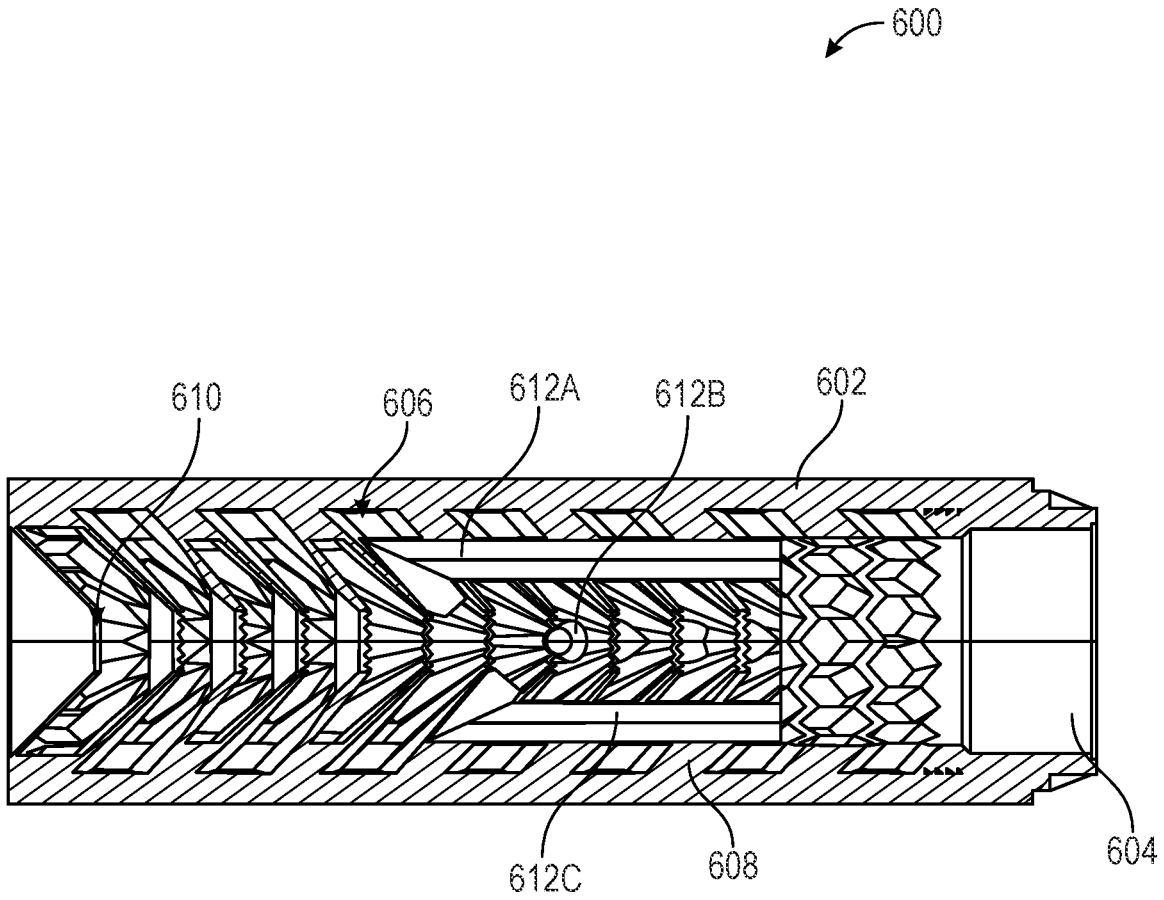
FIG. 16 illustrates a cutaway view of a firearm suppression system.
Figure 17:
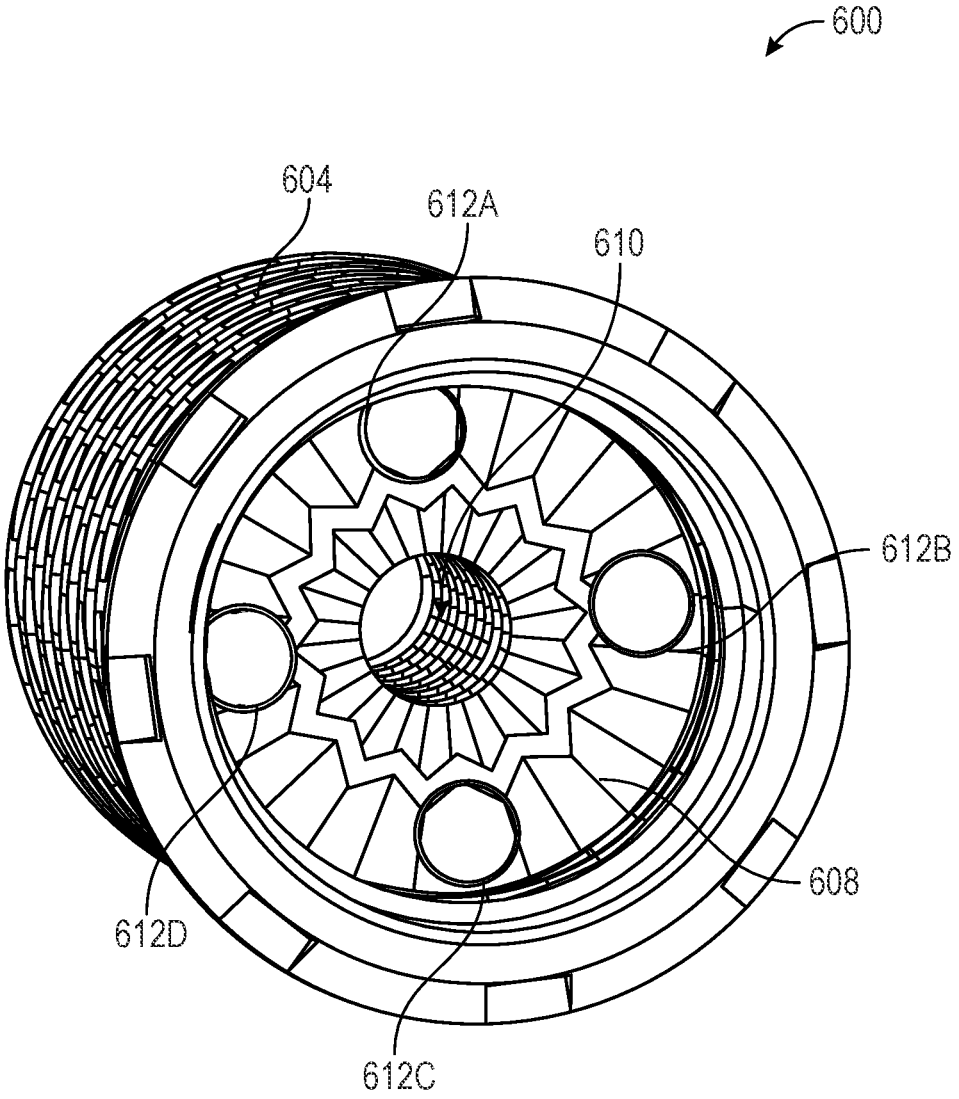
FIG. 17 illustrates a rear perspective view of a core of a firearm suppression system.

As shown in FIGS. 16-17, in one embodiment, a firearm suppression system 600 comprises a housing 602 and a core 604. The core 604 may be removably attachable to the housing 602 and positioned within the housing 602. It will be appreciated that the core 604 may be easily removed from the housing 602 and cleaned, thereby making maintenance of the firearm suppression system 600 simple. The core 604 may be threadably coupled to the housing 602. Further, the core 604 may be substantially cylindrical shaped so as to fit within the housing 602. The core 604 may be printed via a three-dimensional printer, or manufactured by other means known in the art. The core 604 may be titanium, aluminum, ceramic, or other materials known in the art. It will be appreciated that numerous cores may be used with a single housing 602 so as to allow a user to switch cores to address a particular caliber.

An outer surface of the core 604 may comprise a plurality of core apertures 606. The plurality of core apertures 606 may be substantially hexagonal shaped and have the appearance of a honeycomb. The core 604 may include an inner surface that comprises baffles 608 that interact with the plurality of core apertures 606. These baffles 608 may be extruded inward, toward a muzzle when coupled to a firearm, at various prescribed angles. The baffles 608 may be angled between 30 degrees to 70 degrees, but more preferably between 40 degrees to 60 degrees. With baffles 608 being set between the aforementioned ranges, the baffles 608 have additional surface area for heat transfer, thereby reducing the effects of the gasses from the fired projectile. The baffles 608 may be positioned along the length of the core 604. The configuration of the baffles 608 may be generally conically shaped with a hexagonal-like border circumscribing the baffles 608. In some embodiments, the baffles 608 may be corrugated, star shaped, diamond shaped, or any other shape to maximize surface area. It will be appreciated that the configuration of the baffles 608 increases and maximizes surface area for cooling hot gases from the exiting projectile quicker while passing through the system 600. The baffles 608 may angle downward until a projectile passage 610, which may be located at the center of the core 604 and center of the baffles 608 that extends from one end to the other. Passing through one or more of the baffles 608 may be one or more tubes 612A, 612B, 612C, 612D, or pressure reduction channels. That is, for example, a first tube may pass through four baffles while a second tube may pass through three baffles. In some embodiments, channels may replace the one or more tubes 612A, 612B, 612C, 612D, thereby allowing additional gasses to be released throughout the system. The one or more tubes 612A, 612B, 612C, 612D may be generally parallel with the projectile passage 610 until an end portion that may be at an angle (e.g., 70-90 degrees) so as to redirect pressure towards the baffle where the one or more tubes 612A, 612B, 612C, 612D ends and eventually towards the projectile passage 610. Accordingly, the one or more tubes 612A, 612B, 612C, 612D may take pressure from the fired projectile from the high-pressure regions of the suppression system 600 and direct that pressure to a low-pressure region in the opposite direction. For example, this high-pressure gas collides with the gases flowing down the center of the suppressor, the projectile passage 610, causing an interruption to the gas flow. This interruption slows the gases from exiting the firearm suppression system 600 resulting in reduced sound.

Figure 18:
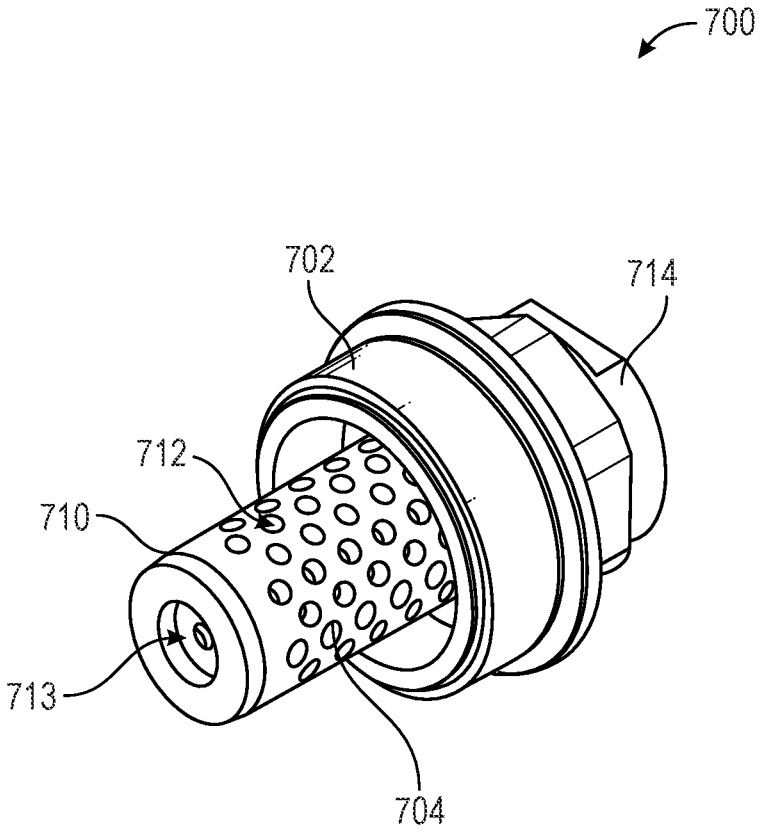
FIG. 18 illustrates a perspective view of a firearm suppression system.
Figure 19:
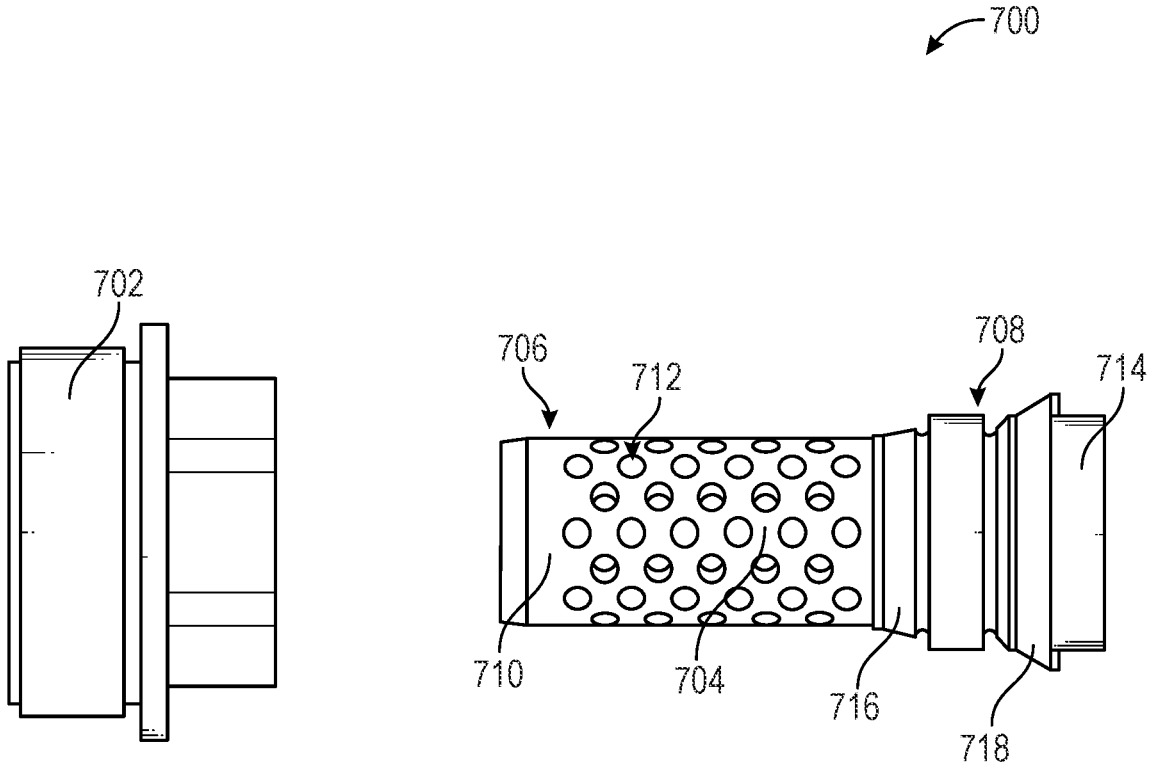
FIG. 19 illustrates a side elevation view of a firearm suppression system.

As shown in FIGS. 18-19, in one embodiment, a firearm suppression system 700 may include a first member 702 coupleable to a muzzle device 704 (e.g., muzzle brake or flash hider), both of which may resemble and have similar functionality to the muzzle adapter 108 in embodiment 100 and shown in FIG. 2. The muzzle brake 704 may include a first portion 706 and a second portion 708. The first portion 706 may have a barrel 710 with a plurality of vent apertures 712. The barrel 710 may have a projectile passage 713. The second portion 708 may comprise a first adapter 714 that interacts with the first member 702 and a barrel of a firearm. The first adapter 714 may comprise a first taper 716 that aligns and prevents gasses from escaping and a second taper 718 that aligns and secures the firearm suppression system 700. The first taper 716 and the second taper 718 may have corresponding tapers that they interact with in the first member 702. The firearm suppression system 700 is a fixed taper system. The muzzle brake 704 may be manufactured by a three-dimensional printing process. In some embodiments, the muzzle brake system 700 may comprise a housing/shell that is removably attachable and encases the muzzle brake 704. Length and width of the muzzle brake 704 may vary.

Figure 20:
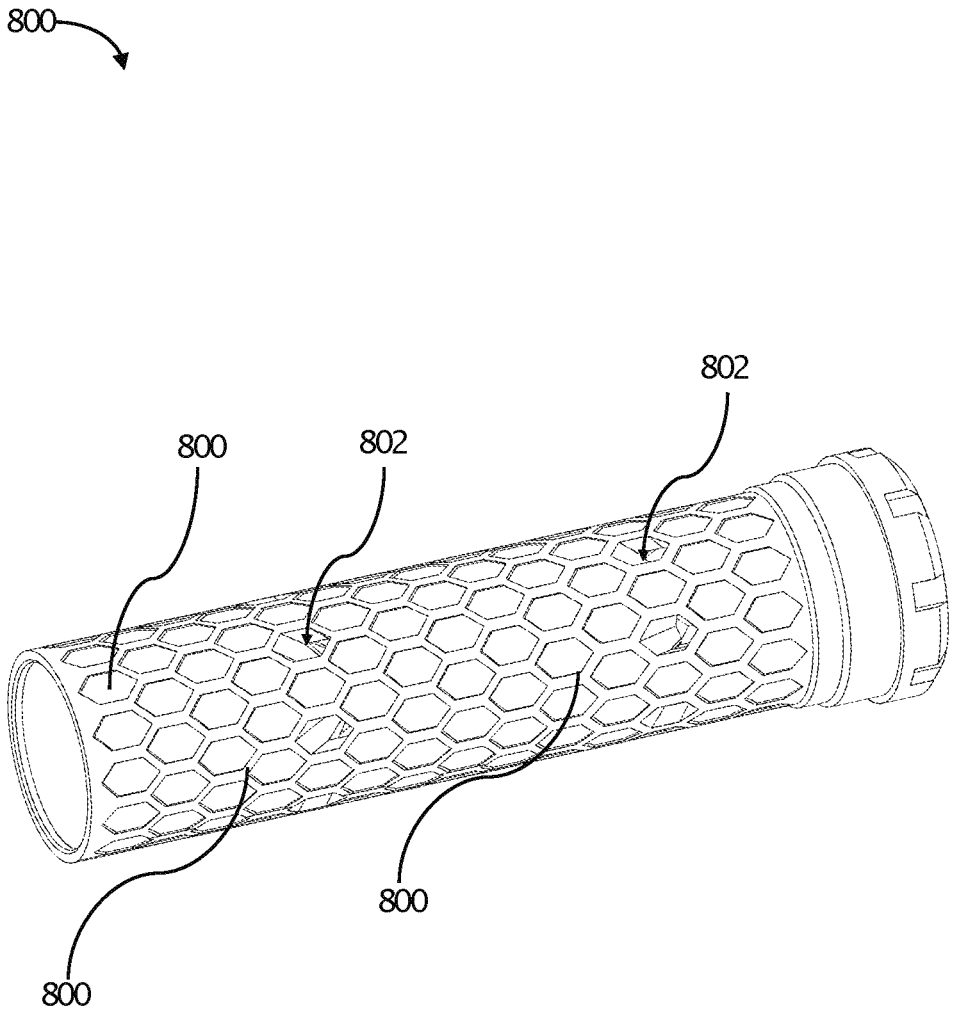
FIG. 20 illustrates a side perspective view of a core of a firearm suppression system.

As shown in FIG. 20, in one embodiment, a core 800 may comprise one or more vent apertures 802 and a plurality of sealed vent apertures 804. Both the one or more vent apertures 802 and the plurality of sealed vent apertures 804 may lead to baffles, similar to the embodiments discussed above. It will be appreciated that with a few vent apertures 802 only small amounts of pressure may be released therethrough and the gasses exiting through the vent apertures 802 may be redirected through various other vent apertures 802 and back towards the projectile aperture in the core.

It will be understood that while various embodiments have been disclosed herein, other embodiments are contemplated. Further, certain embodiments of the present disclosure may include, incorporate, or otherwise comprise properties or features described in other embodiments. Consequently, various features of certain embodiments can be compatible with, combined with, included in, and/or incorporated into other embodiments of the present disclosure. Therefore, disclosure of certain features or components relative to a specific embodiment of the present disclosure should not be construed as limiting the application or inclusion of said features or components to the specific embodiment unless stated. As such, other embodiments can also include said features, components, members, elements, parts, and/or portions without necessarily departing from the scope of the present disclosure.

The embodiments described herein are examples of the present disclosure. Accordingly, unless a feature or component is described as requiring another feature or component in combination therewith, any feature herein may be combined with any other feature of a same or different embodiment disclosed herein. Although only a few of the example embodiments have been described in detail herein, those skilled in the art will appreciate that modifications are possible without materially departing from the present disclosure described herein. Accordingly, all modifications may be included within the scope of this invention.

What is claimed is:

1. A firearm suppression system comprising:

a housing comprising a first end and a second end, the housing comprising:

a first aperture at the first end, a second aperture at the second end;

an inner compartment interposed between the first aperture and the second aperture, the inner compartment being substantially the same circumference from the first end to the second end;

an end cap with a projectile aperture; and a core removably attachable to the housing and positioned therein, wherein the core comprises a plurality of core apertures on an outer surface that allow gas passing from a projectile and cartridge to pass to a channel between the inner surface of the housing and an outer surface of the core, the channel circumscribes the outer surface of the core and equalizes pressure that begins at the first end of the housing and terminates at the second end of the housing.

2. The firearm suppression system of claim 1, wherein the core is printed from a three-dimensional printer.

3. The firearm suppression system of claim 1, wherein the end cap comprises a plurality of vent apertures.

4. The firearm suppression system of claim 1, further comprising a muzzle adapter.

5. The firearm suppression system of claim 1, wherein the end cap comprises a second side that comprises a ledge that rests upon and is flush with the second end.

6. The firearm suppression system of claim 1, wherein the end cap comprises a sidewall that is positioned in the inner compartment and rests against an inner surface of the housing.

7. The firearm suppression system of claim 6, wherein the sidewall comprises threads that couple to the housing.

8. The firearm suppression system of claim 1, further comprising a disc interposed between the end cap and the core.

9. The firearm suppression system of claim 1, wherein the plurality of core apertures is substantially hexagonal shaped.

10. The firearm suppression system of claim 1, wherein the core comprises an inner surface that includes baffles that interact with the plurality of core apertures.

11. The firearm suppression system of claim 10, wherein the baffles are extruded inward.

12. The firearm suppression system of claim 1, wherein the core includes an end cap baffle proximate the end cap in the housing, the end cap baffle comprising baffle apertures that function in tandem with a plurality of vent apertures on the end cap.

13. A firearm suppression system comprising:

a housing comprising a first end and a second end, the housing comprising:

a first aperture at the first end, a second aperture at the second end;

an inner compartment interposed between the first aperture and the second aperture, the inner compartment being substantially the same circumference from the first end to the second end;

an end cap actuated by pressure, the end cap comprising:

a projectile aperture;

a pressure channel running parallel to the projectile aperture;

a closure channel that is perpendicular to the pressure channel, the closure channel passing from an outer surface of the end cap to the projectile aperture;

a core removably attachable to the housing and positioned therein, the core comprising:

a plurality of core apertures, and one or more baffles that interact with the plurality of core apertures;

wherein the end cap comprises a closure member that is positionable in the closure channel proximate the outer surface.

14. The firearm suppression system of claim 13, further comprising a key placed in the closure channel.

15. The firearm suppression system of claim 14, wherein the key comprises a head and a shaft, the shaft extendible into the projectile aperture.

16. The firearm suppression system of claim 14, wherein the key comprises a spring positioned below the head, around the shaft, and resting on a projectile ledge in the closure channel.

17. A firearm suppression system comprising:

a housing comprising a first end and a second end, the housing comprising:

a first aperture at the first end, a second aperture at the second end;

an inner compartment interposed between the first aperture and the second aperture, the inner compartment being substantially the same circumference from the first end to the second end;

a muzzle adapter threadably coupled to the first end and removably attachable to a barrel of a gun;

an end cap with a projectile aperture;

a core removably attachable to the housing and positioned therein, the core comprising:

a plurality of core apertures, one or more baffles that interact with the plurality of core apertures, and one or more pressure reduction tubes that each pass through a predetermined number of baffles, the one or more pressure reduction tubes comprise an angled end portion that angles toward the first end of the housing; and a disc interposed between the end cap and the core.

* * * * *